United States Patent [19]

McCormick et al.

[11] 4,134,109

[45] Jan. 9, 1979

[54] ALARM SYSTEM RESPONSIVE TO THE BREAKING OF GLASS

[75] Inventors: Richard E. McCormick, Tempe, Ariz.; Alfred Schneider, Cedar Rapids, Iowa

[73] Assignee: Omni Spectra, Inc., Tempe, Ariz.

[21] Appl. No.: 796,997

[22] Filed: May 16, 1977

[51] Int. Cl.[2] ..... G08B 13/04

[52] U.S. Cl. ..... 340/550; 340/566

[58] Field of Search ..... 340/261, 274 R

[56] References Cited

U.S. PATENT DOCUMENTS 3,824,532 7/1974 Vandierendonck ..... 340/261

3,958,213 5/1976 Scott et al. ..... 340/261

3,974,489 8/1976 Bleeker et al. ..... 340/261

*Primary Examiner*—Glen R. Swann, III

*Attorney, Agent, or Firm*—Joseph H. Roediger

[57] ABSTRACT

An alarm system for detecting the pattern of acoustic signals resulting from the breaking of glass utilizes transducers to convert the acoustic waves to electrical signals and then analyzes the signal strength, the frequency content and the pattern of the signal and no signal intervals to discriminate the breaking of glass from background or spurious noises. The system also determines the level of background noise and compensates therefor in determining whether an alarm signal is to be generated.

20 Claims, 5 Drawing Figures

ALARM SYSTEM RESPONSIVE TO THE BREAKING OF GLASS

BACKGROUND OF THE INVENTION

This invention relates to an alarm system for detecting the breaching of security of an installation and, in particular, the detecting of the breaking of glass enclosures.

The present day need for security systems is an ever increasing one with the statistics relating to forcible entry, burglary and the like continually rising. As a result a multiplicity of systems and devices designed to sense unwanted intrusions and physical damage have appeared in the marketplace. The problems of security are particularly severe in installations wherein the premises or goods are exhibited to the public. The viewing medium used in these structures is typically glass which can be readily shattered and the premises entered.

To achieve a measure of security in glass-enclosed environments, the use of aluminum foil conductors mounted on the inner surface of the glass enclosures is presently utilized in many establishments. The system when activated relies on the uninterrupted flow of a direct current through these conductors. The breaking of the glass enclosure severs the tape, interrupts the current flow and triggers the alarm. Thus, each window and glass enclosure must be provided with the properly mounted and appropriately located aluminum foil strips and the system is expensive to install as well as detracting from the appearance of the structure and the goods viewed therethrough.

Also, the foil conductors are fragile and often severed by window washers or other employees thus requiring repair or replacement. This type of accident is usually discovered and corrected for without generating a false alarm. However, difficulties in matching temperature coefficients of expansion of glass and foil often open circuit the conductor and this is not noticed until the alarm is needed or activated. As a result, considerable interest has been generated in alternate alarm systems which require lower maintenance and do not detract from the display.

One system that has been utilized as an alternative to conductive foil strips employs mercury switches physically attached to the glass enclosure in a position such that the shock associated with the breaking of the glass enclosure is transmitted directly to the switch. The shock alters the attitude of the mercury in the switch and either opens or closes the electrical circuit to activate the alarm. This system has been found to encounter difficulties in adequately bonding the switches to the window so that the shock waves are transmitted to the switch.

Attempts have also been made to utilize remotely located sensors that are activated by the sound waves generated by the breaking of the glass enclosures. Systems of this type have not generally been satisfactory in environments wherein background noise is present or likely to be encountered since the extraneous noises often activate the alarm.

Accordingly, the present invention is directed to the provision of an alarm system for structures having glass enclosures wherein the sensors are remotely located. Further, the sensors pick up the acoustic waves generated by the initial breaking of the glass enclosure and, following an interval of low noise, the subsequent acoustic waves generated by the broken glass coming to rest at its landing place in order to essentially eliminate false alarm signals being generated.

The present alarm system is characterized by its ability to generate an electrical alarm signal from a pattern of acoustic signals such as that resulting from the breaking of a glass enclosure in environments wherein extraneous noises are likely occurrences. This sensitivity to actual conditions is due in part to a series of timing, magnitude and frequency content determinations performed by the present invention.

SUMMARY OF THE INVENTION

This invention is concerned with a system for identifying a sequence containing intermittent acoustic signals, such as those associated with the breaking of a glass enclosure, and generating an electrical alarm signal in response thereto. The system is capable of identifying this sequence and discriminating between this sequence and background noise which might either reduce its sensitivity or provide false alarm conditions.

The system includes a plurality of remotely located transducers which are spaced to receive any acoustic waves generated within the area to be monitored. The transducers convert the acoustic signals received to electrical signals. The output terminals of the transducers are connected to a summing point which is coupled to different elements of the system.

A threshold amplifier is coupled to the summing point and provides an output signal if the signal received from the transducers has a magnitude that is at least as large as the threshold level. A timing circuit is coupled to the threshold means and is activated by the signal therefrom to generate control signals for other portions of the system in accordance with the acoustic pattern to be identified and responded to.

The system further includes a signal switch actuated by a first control signal from the timing circuit with the switch being coupled between the summing point and a signal analyzing means. The timing circuit provides the first control signal after it has been actuated by the threshold amplifier. Consequently, the signal analyzing means receives a subsequent signal in the pattern of signals received by the transducers.

The signal analyzing means is actuated by a second control signal from the timing circuit and provides an output signal if it finds that at least one selected frequency component is present in the signal from the signal switch. The output from the signal analyzing means is supplied to an output logic means wherein it is stored for subsequent operation.

The output logic means is also coupled to the signal switch means and determines if the subsequent or second signal in the acoustic pattern terminates after an interval. In addition, the output logic means is coupled to the timing circuit and receives a third control signal therefrom. The third control signal determines the length of the interval within which the subsequent acoustic signal is required to terminate before the system output signal is generated. The output logic means provides the system output signal upon receipt of the signal analysis output signal and the determination that the acoustic signals received by the transducers have terminated at or prior to the time of the third control signal.

In summary, the present invention generates a system output signal indicating the receipt of a pattern of acoustic signals by determining if the initial signal received has a minimum magnitude and, if so, the subsequent acoustic signal is analyzed for frequency content. Then, the system determines if the subsequent acoustic signal has terminated by the end of an interval. When these conditions have been found to have occurred, the system generates an output signal which can be utilized to trigger an alarm.

This system has been found well suited for identifying the breaking of glass panels wherein the pattern of acoustic signals is comprised of the initial breaking of the glass due to the application of force which provides a low frequency signal, a period of relative silence as the broken glass travels downward, a wideband acoustic signal due to the interaction of the broken glass as it encounters the floor followed by a period of relative silence. Further features and advantages of the foregoing invention will become more readily apparent from the following detailed description of a specific embodiment of the invention when taken in conjunction with the accompanying drawings.

DESCRIPTION OF THE PREFERRED EMBODIMENT

Figure 1:
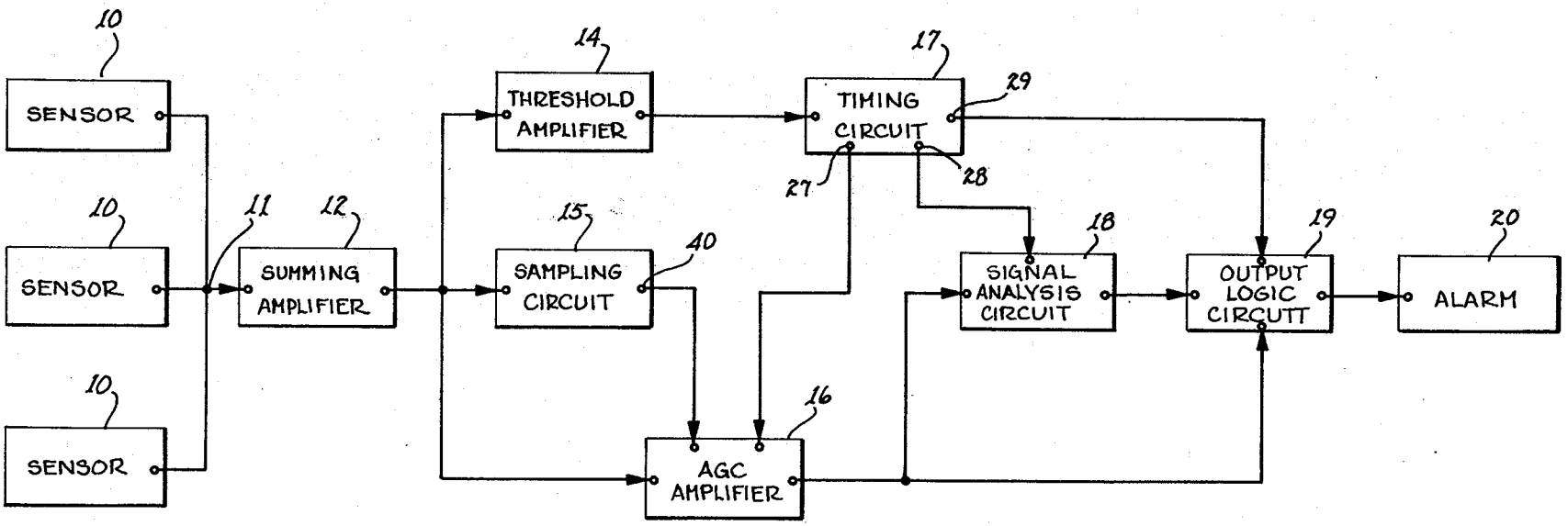
FIG. 1 is a block schematic diagram of an embodiment of the invention.

Referring now to FIG. 1, the alarm system is shown including remote sensors 10 having the outputs coupled to a summing point 11. The sensors are transducers, such as conventional microphones, which receive acoustic waves and generate corresponding electrical signals in response thereto. The sensors are placed within the protected installation so as to monitor the breaking of glass at spaced locations proximate to the regions being monitored. The number and placement of the sensors utilized is determined by the particular installation.

Since the sensors may be located at a considerable distance from the signal processing elements of FIG. 1, summing amplifier 12 is shown as providing preamplification to raise the signal strength to a level suited for the subsequent processing circuits. In certain applications, a summing amplifier need not be utilized. As shown, the amplified signal from the summing point is coupled to threshold amplifier 14, sampling circuit 15 and AGC amplifier 16.

Figure 2:
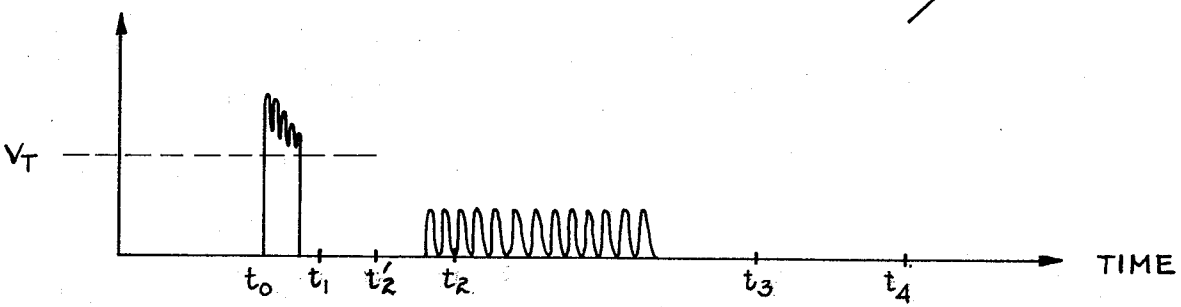
FIG. 2 shows the waveform of the acoustic signal pattern associated with the breaking of a glass enclosure.

The electrical signals received from sensors 10 are the analogues of the acoustic signals detected by sensors 10. Thus, the electrical signals can be processed by the system to determine if the particular pattern of acoustic signals to be identified has been received and to generate the alarm signal. A typical pattern of acoustic signals indicative of the breaking of a glass enclosure is shown in FIG. 2.

At time $t_0$ the glass enclosure, typically a plate glass window, is broken by the sudden application of a force that generates a large amplitude signal lasting a relatively short period of time. The recognition of the large amplitude signal is provided by threshold amplifier 14 which provides an output signal to timing circuit 17 when the received signal is at least as large as a predetermined threshold level $V_T$. The threshold level is determined in part by the size and type of the glass enclosures being monitored.

The electrical signals following the initial signal, namely signals after $t_1$, but before $t_2$ are supplied to sampling circuit 15 which provides an output signal that is a function of the peak magnitude of the signals received during the interval $t_2-t_1$ for the remaining portion of time required to identify the acoustic pattern. This output signal is the gain control signal for AGC amplifier 16 and sets the gain during interval $t_2-t_1$. The AGC amplifier is actuated by a first control signal from timing circuit 17 and is not operative during the initial $t_1-t_0$ interval. Thus, the level of the first received signal is utilized by threshold amplifier 14 to determine if the glass has been broken. The level of the second received signal sets the gain control for amplifier 16 for subsequent operations.

The output signal from the threshold amplifier activates the timing circuit which provides first, second and third control signals for amplifier 16, signal analysis circuit 18 and output logic circuit 19 at control terminals 27, 28 and 29 respectively. The first and second signals are generated at time $t_2$ when the next acoustic signal in the pattern is to be received. When this subsequent acoustic signal is sensed, the corresponding electrical signal is amplified by amplifier 16 which provides its output signal to signal analysis circuit 18 and output logic circuit 19. It should be noted the amplifier 16 is actuated by the timing circuit at $t_2$ and therefore signals occurring during the interval $t_2-t_1$ are not supplied to circuits 18 and 19. This interval $t_2-t_1$ is utilized to set the gain of amplifier 16.

The subsequent acoustic signal occurring at time $t_2$ is shown in FIG. 2 as extending for an interval less than $t_3-t_2$. This signal is generated by the pieces of the broken glass coming to rest on the floor and on top of one another and is relatively low amplitude signal when contrasted with the initial signal generated by the force applied to the glass enclosure initially. During interval $t_2'-t_1$, no significant acoustic signals are generated since the pieces of glass are travelling through the air before interacting and coming to rest. To verify that the acoustic signal in interval $t_3-t_2$ is generated by the fractured glass coming to rest, the amplified signal from AGC amplifier 16 is supplied to signal analysis circuit 18 wherein at least one frequency component is looked for and, if found to be present, an output signal is supplied to output logic circuit 19.

The first control signal actuating AGC amplifier 16 continues beyond time $t_3$ until time $t_4$ and consequently any signals received will be supplied to both the signal analysis circuit 18 and output logic circuit 19. However, the second control signal occurs during the interval $t_3-t_2$ and, as a result, the signal analysis circuit only looks at signals received during that interval. The third control signal provided by timing circuit 17 occurs during $t_4-t_3$ and, thus, output logic circuit 19 is responsive to the presence or absence of signals received during this interval. Since the acoustic pattern to be identified is characterized in part by the cessation of any significant signal at time $t_3$ as the glass will have come to rest, the output logic circuit 19 generates the alarm signal which activates alarm 20 in the absence of a signal during interval $t_4-t_3$. In summary, the output logic circuit receives an output signal from analysis circuit 18 if the appropriate frequency check is satisfied, stores this information, determines if there is a signal received after time $t_3$ and if no signal has been received during $t_4$–$t_3$ when the third control signal is generated, the alarm 20 is activated.

Figure 3:
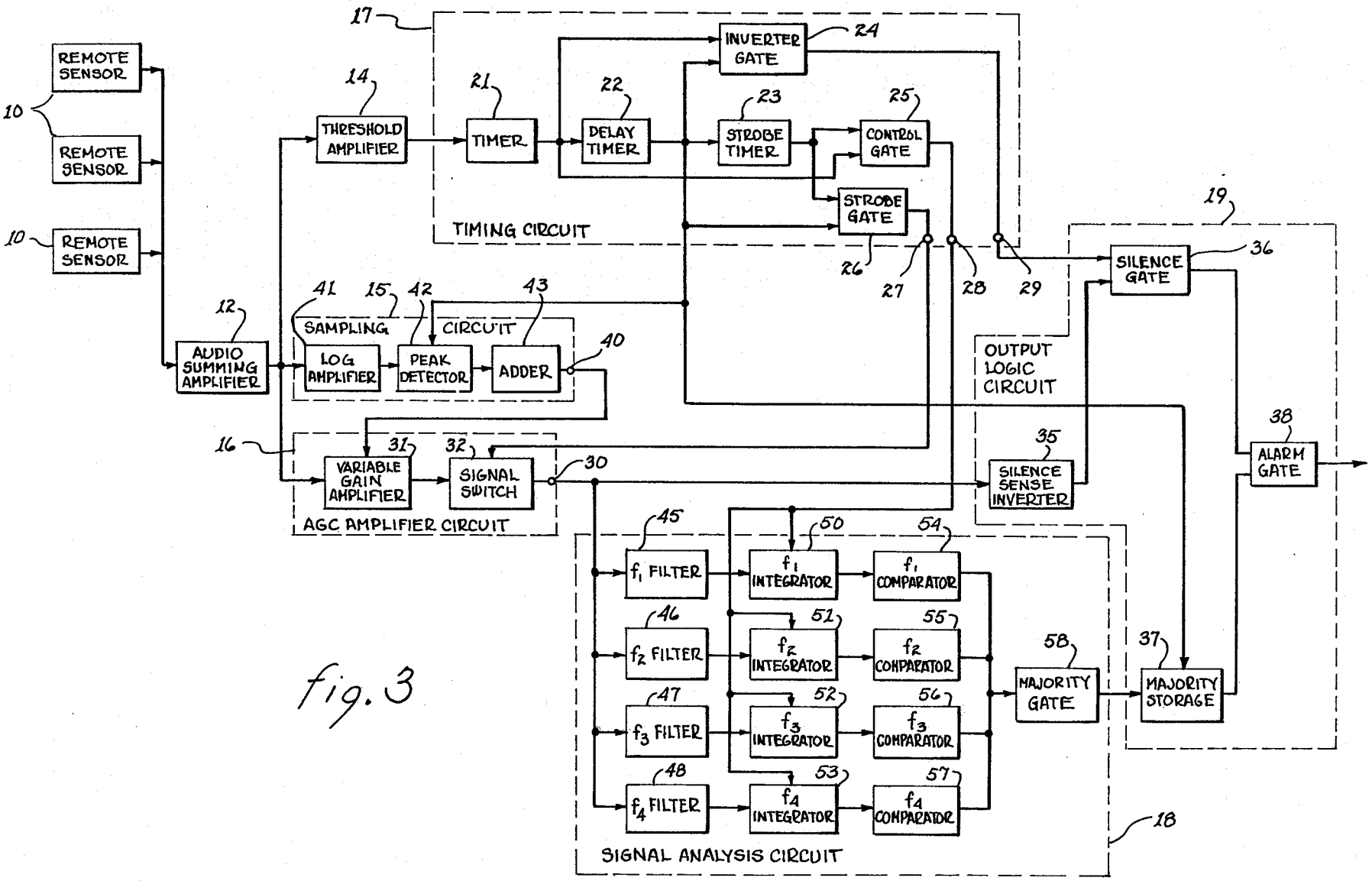
FIG. 3 is a more detailed block schematic diagram of the embodiment of FIG. 1.
Figure 4:
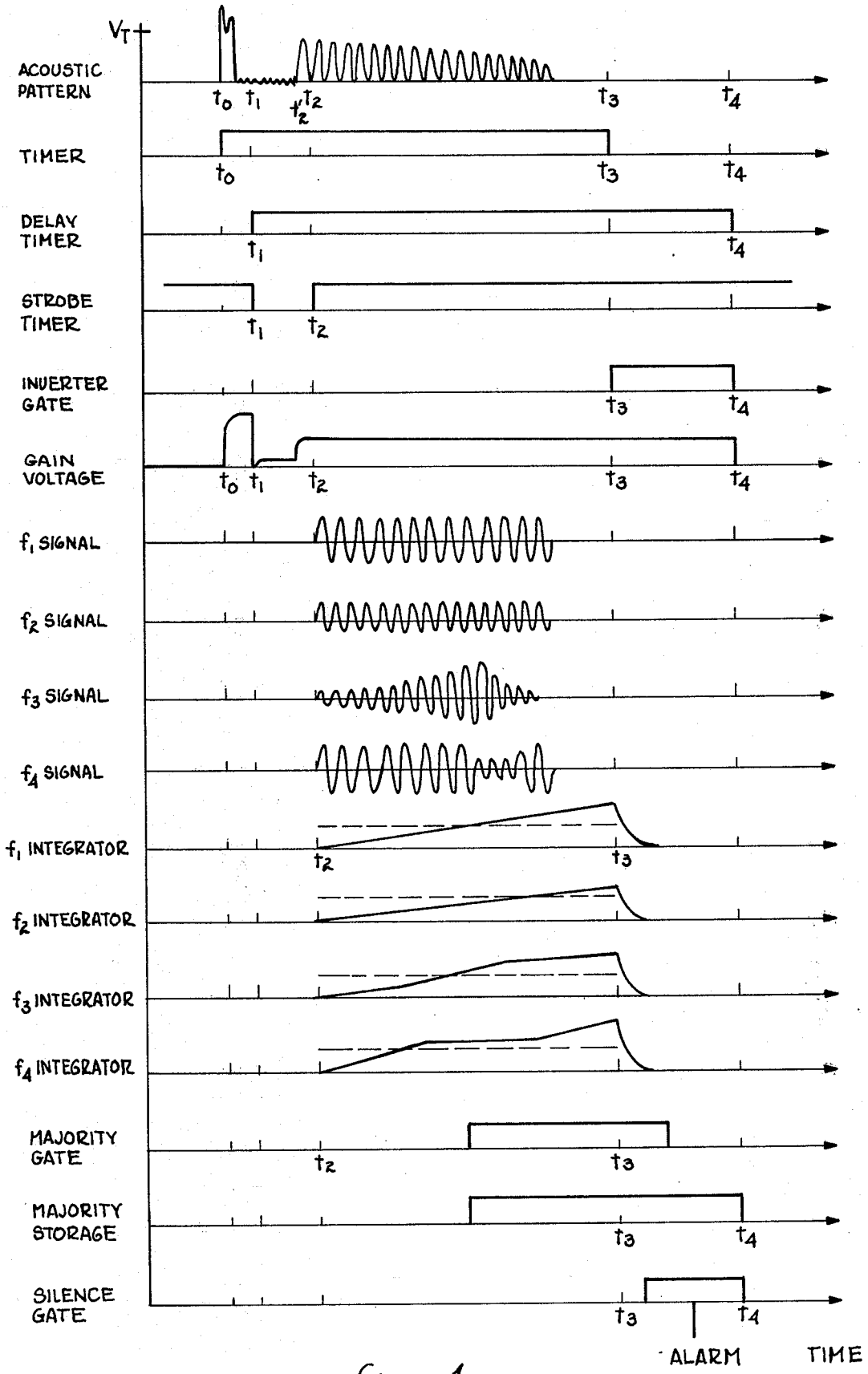
FIG. 4 shows the waveforms associated with the operation of the block diagram of FIG. 3.

The operation of the system is shown in greater detail in the block schematic diagram of FIG. 3 and the associated timing diagram of FIG. 4 with the major blocks of the diagram of FIG. 1 being identified by the dashed lines and captions.

The acoustic pattern to be identified is shown in the first waveform of FIG. 4 as including the large magnitude sound associated with the fracture of the glass enclosure followed by the interval of silence as the glass fragments travel to their resting place. At time $t_2$,' the glass fragments interact and provide a wide band relatively low magnitude signal as they come to rest followed by a period of silence during the interval $t_4$–$t_3$. These acoustic signals are received by the remote sensors 10 located within the building to monitor the different glass walls, doors and display panels. The electrical output signals of the sensors are coupled to an audio summing amplifier 12 which increases signal strength and removes high frequency signals outside the audio frequency range.

The combined signal from amplifier 12 is supplied to threshold amplifier 14, sampling circuit 15 and AGC amplifier circuit 16. The threshold amplifier provides an output signal only if the first acoustic signal received at $t_0$ has a magnitude at least equal to voltage $V_T$. This circuit provides the first check in the recognition of the acoustic pattern since the step-function type first signal must be strong enough to indicate that one of the glass panels has been broken and not merely struck with insufficient force. In practice, this amplifier is provided with a threshold level that can be adjusted at the time of installation in order to compensate for the presence of significant background noise when the alarm system is operational.

If a glass panel has been broken the strength of the signal is at or above the threshold level and the amplifier 14 provides an output signal shortly after $t_0$ thereby activating timing circuit 17 by causing timer 21 to generate an output signal from about time $t_0$ to $t_3$. This signal is supplied to delay timer 22 which generates an output signal from $t_1$ to $t_4$. The delay timer signal actuates strobe time 23 which provides an output signal from $t_2$ to $t_4$. In practice, the strobe timer is a monostable circuit having a normally high output state and is placed in the low output state during $t_2$–$t_1$ by the delay timer. These three timer circuits with their output signals as shown in the waveforms of FIG. 4 are utilized in a number of gates to control the timing of the operation of other alarm system components by the control signals at control terminals 27, 28 and 29.

The first control signal at terminal 27 is from strobe gate 26 which provides the signal upon the coincident application of the delay timer signal and the strobe timer signal. Thus, the first control signal occurs during the interval $t_4$–$t_2$ and is supplied to signal switch 32. The second control signal at terminal 28 is from control gate 25 which provides the signal upon the coincident application of the timer signal and the strobe timer signal. As a result, the second control signal occurs at time $t_2$ but terminates at time $t_3$, prior to the termination of the first control signal.

The third control signal at terminal 29 is supplied to silence gate 36 from inverter gate 24. Gate 24 provides an output signal when there is an output signal from the delay timer but no output signal from the timer. Consequently, the third control signal occurs during interval $t_4$–$t_3$ at the end of the acoustic pattern being identified. This signal controls the time of generation of the alarm signal if the acoustic pattern received has satisfied the magnitude, timing and frequency content tests performed by the remaining portions of the system.

In addition to the electrical signal being applied at $t_0$ to threshold amplifier 14, the signal is also supplied to logarithmic amplifier 41 and variable gain amplifier 31. The amplifier 41 provides an output signal which is a function of the peak magnitude of the signal after $t_1$ and is supplied to peak detector 42 which is allowed to charge to this signal after $t_1$ when the delay timer has switched high. The detector substantially maintains its output signal level until $t_4$ when it is reset due to the termination of the delay timer signal. In the embodiment shown, a logarithmic amplifier is utilized to adjust gain due to the great difference in the magnitudes of the initial and second acoustic signals. The signal from the peak detector is shown coupled to adder 43 which is preferably a level compensation circuit for adding or subtracting a dc level to the peak detector signal based on the environment. In summary, the log amplifier 41 and peak detector 42 provide a component of the gain voltage at terminal 40 which is determined by the strength of the signal caused by dropping pieces of glass plus the noise of the outside environment, and not the strength of signal of the initial fracture of the glass while the adder is a level adjustment that considers primarily the ambient temperature at the signal processor and provides compensation for the semiconductor elements of amplifier 41. Also, if the surface is soft, for example carpeted, the adder can be set at installation to add a fixed bias to the peak detector signal. The waveform of the gain voltage at terminal 40 is shown in FIG. 4.

The gain voltage level at terminal 40 controls the amount of gain of amplifier 31. However, the output of amplifier circuit 16 is controlled by signal switch 32 which in turn is actuated by the first control signal from the timing circuit and, therefore, no signal is present at terminal 30 until $t_2$ at which time the subsequent or second signal in the acoustic pattern is to occur. As mentioned previously, the first control signal has a duration of $t_4$–$t_2$ and thus signals occurring during this interval are coupled at terminal 30 to signal analysis circuit 18 and output logic circuit 19.

As shown in the first waveform of FIG. 4, the second acoustic signal occurs at time $t_2'$ and prior to time $t_2$. This signal results from the interaction of the pieces of glass with each other and with the surface that they ultimately come to rest on. No significant signal is encountered during the interval $t_2$+–$t_1$ when the enclosure has been broken and the pieces and fragments are travelling through the air. The second signal at terminal 30 is supplied to the narrow bandpass filters 45, 46, 47 and 48 which are tuned to pass four audio frequencies which can be nonharmonically related. The output signals of the four filters are shown in FIG. 4 as the $f_1$–$f_4$ signals and it should be noted that the energy in these different signals differs significantly.

The output signal from each filter is supplied to a corresponding integrator 50 through 53, each of which provides an output shown by the waveforms of FIG. 4 that is a function of the energy received during the $t_3$–$t_2$ interval for that particular narrow band of frequencies. The output signal from each integrator is supplied to a corresponding comparator 54 through 57. Each comparator generates an output signal when the signal from its corresponding integrator exceeds a threshold level, shown by the dashed line in the $f_1$ through $f_4$ integrator waveforms of FIG. 4. In the preferred embodiment shown in FIG. 3, the output signals of the four comparators are supplied to a majority gate 58 which operates to provide an output signal when a majority of the input signals are high which in this case means that at least three frequency components passed by the filters have sufficient energy therein to exceed the levels of the corresponding comparators during the interval $t_3$–$t_2$. It should be noted that the integrators 50, 51, 52 and 53 are each coupled to terminal 28 of the timing circuit and, thus, are placed in operation for the duration of the second control signal.

The majority gate 58 supplies a signal to majority storage circuit 37 of the output logic circuit. The determination that the second acoustic signal is a wideband audio signal occurring during the interval $t_3$–$t_2$ is utilized to insure that random signals do not provide an erroneous alarm signal. This information is stored by the output logic circuit while an additional determination is made that the signals have terminated at time $t_3$. As mentioned previously, the first control signal at terminal 27 actuates signal switch 32 for the interval $t_4$–$t_2$ so that the signals from the amplifier circuit are supplied to silence sense inverter 35 of the output logic circuit. The inverter 35 provides no output signal until its input signal is essentially at zero level for a particular interval. In the embodiment shown, the inverter 35 looks for a no signal condition at its input at time $t_3$ and then generates an output signal. The inverter output signal is supplied to silence gate 36 which also receives the third control signal from the timing circuit 17. This control signal at terminal 29 occurs between $t_3$ and $t_4$ and, thus, the concurrent application of the signal from the inverter 35 provides a signal to alarm gate 38. The other input signal for alarm gate 38 is the stored majority signal indicating the signal analysis resulted in a majority of frequency components exceeding the threshold energy level. Thus, the output of the alarm gate 38 occurs during the $t_4$–$t_3$ interval and is coupled to the desired indicating device which depends upon the particular type of installation.

Also, the delay timer 22 has its signal coupled to peak detector 15 and majority storage 37 for discharging these two circuits at time $t_4$. In operation one or both of these circuits is charged by the occurrence of other patterns of acoustic signals which are discriminated against and do not result in an alarm condition. To insure that the alarm system is promptly responsive to following acoustic signals, the delay timer signal is utilized to inhibit the discharge of the storage elements until the termination of the delay timer signal when rapid discharge takes place.

The foregoing description of the embodiment of FIG. 3 and the associated waveforms of FIG. 4 points out that the system identifies the pattern of acoustic signals by performing a multiple test sequence including magnitude determinations, frequency analysis, energy level determinations, intermittent signal requirements and a termination check of received signals at a particular point in time. Further, the initial magnitude determination can be fixed with reference to the type of glass enclosures being monitored. Also, the gain control compensates for different acoustic conditions at the time of glass pieces striking each other while the adder circuit compensates for the ambient temperature.

In one embodiment tested, the system operated successfully to discriminate the particular acoustic pattern associated with one-quarter inch plate glass windows in a number of different environments without experiencing false triggering due to a variety of extraneous noises such as sirens, whistles, bells, chimes, buzzers, air flows through duct work and the associated expansion and contraction thereof.

The system was tested successfully in hard environments wherein ceramic tile and metal partitions were utilized as construction elements and also in soft environments characterized by acoustic tile, drapes and carpeting. The type of environment determines the proximity of the sensors to the glass enclosures with distances within the range of 10 to 60 feet being an approximate range. In the tested embodiments, the timing intervals established by the timing circuit were $t_1$ = 50 ms, $t_2$ = 150 ms., $t_3$ = 2.0 sec. and $t_4$ = 3.0 sec. with $t_2$ and $t_3$ having been selected for one foot minimum glass height and with $t_3$ and $t_4$ having been selected for eight foot maximum glass height.

Figure 5:
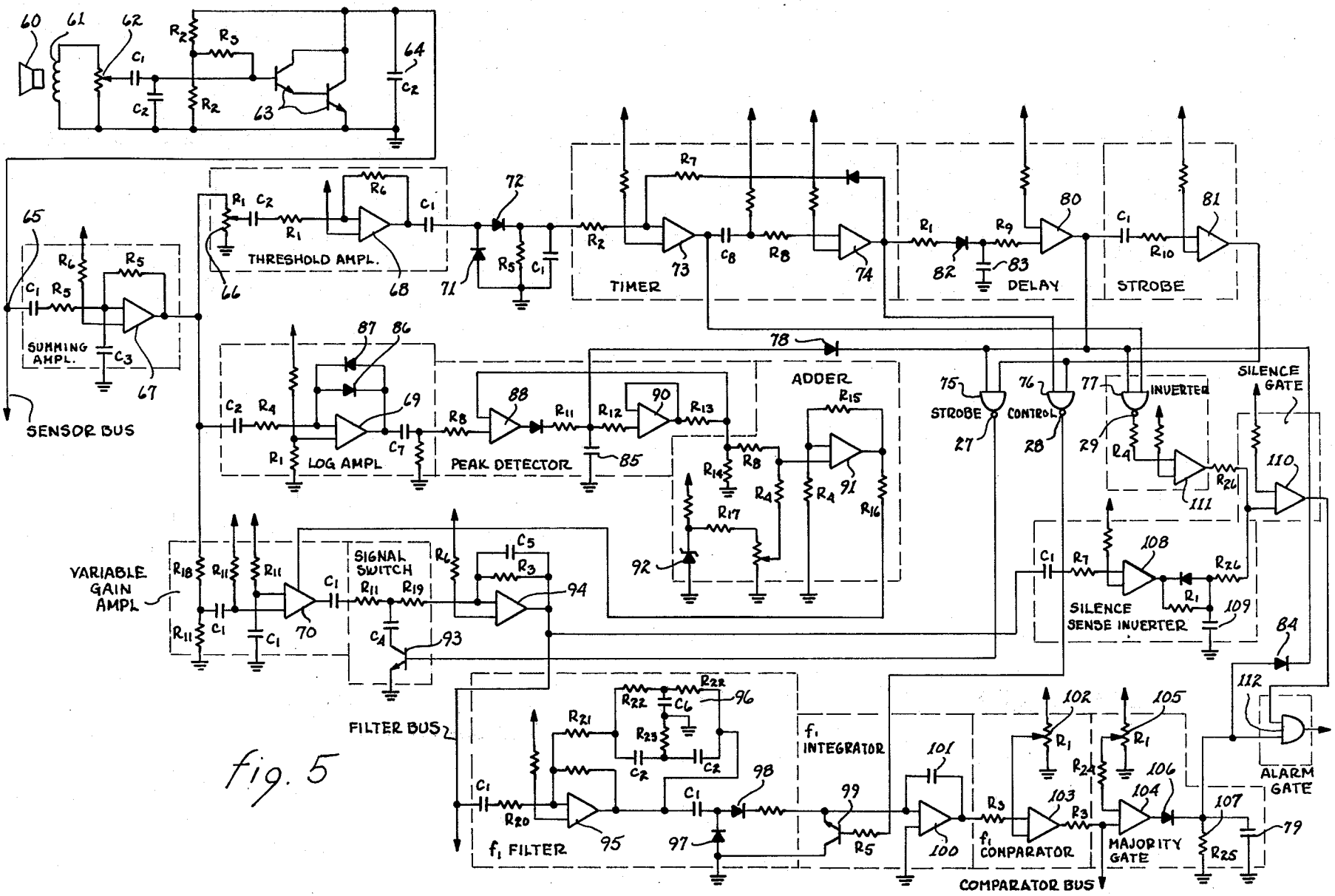
FIG. 5 is an electrical schematic diagram of one embodiment of the invention.

The electrical schematic diagram for the embodiment of FIG. 3 is set forth in FIG. 5 wherein the microphone 60 is inductively coupled to coil 61 with the signal pickup appearing across resistor 62 being amplified by the Darlington transistor pair 63. As shown, resistor 62 is adjustable to compensate for individual microphone characteristics. The high frequency components are filtered by the shunt capacitor and the signal appears at terminal 65 on the sensor bus. Additional microphones and associated pickup circuitry are coupled to this terminal.

All signals at terminal 65 are supplied to operational amplifier 67 wherein signal strength is increased. The output signal from the amplifier 67 is coupled to operational amplifiers 68, 69 and 70. Amplifier 68 is part of a threshold amplifier circuit with the threshold level being determined in part by the location of the adjustable tap on resistor 66. The tap can be changed depending on the environment in which the alarm system is to be utilized. For "soft" environments the threshold is lowered.

The input signal exceeding the threshold level provides an output signal which is rectified by the combination of diodes 71, 72 with the positive portion being coupled to operational amplifier 73. Amplifiers 73 and 74 are connected as a monostable timing circuit which provide timer signals for the control gate 76 and inverter gate 77. The timer signal waveform is shown in FIG. 4. The signals from amplifiers 73 and 74 are out of phase in the particular configuration of FIG. 5 due to the use of NOR gates 75, 76 and 77, but it should be noted that the timing of the signals from amplifiers 73 and 74 is such that the normally high output state of amplifier 73 changes at the same time that the normally low output of amplifier 74 goes high. The output signals of the timer circuit commence when the acoustic signal at the microphone exceeds the threshold level and continues until time $t_3$ of FIG. 4.

Also, the output signal from amplifier 74 is supplied to operational amplifier 80 which delays the positive and negative-going edges of the timer due to the diode 82 and capacitor 83. The presence of diode 82 provides an increased delay of the trailing edge of the timer pulse in this embodiment so that the delay timer waveform, shown in FIG. 4, occurs during the interval $t_4$–$t_1$ where interval $t_4$–$t_3$ is longer than the length of interval $t_2$–$t_1$. The delay timer signal is supplied to gates 75, 77 and also to the alarm gate and the peak detector via diodes 84 and 78 respectively. When the delay timer output signal is high, the diodes are biased nonconductive and when the signal is terminated the capacitors 85 and 79 are discharged to reset the system for subsequent received acoustic signals.

The output signal from amplifier 80 is supplied to operational amplifier 81 which has a normally high output signal. At time $t_1$ when the delay timer signal goes high, as shown in FIG. 4 the output signal of amplifier 81 goes low for the interval $t_2$–$t_1$. The output signal from amplifier 81 is supplied to NOR gates 75 and 76.

The output terminals 27, 28 and 29 of NOR gates 75, 76 and 77 respectively correspond to the timing circuit output terminals at same number shown in FIGS. 1 and 3. The signals at these terminals control the timing of the circuits of the system in accordance with the timing of the acoustic pattern to be responded to as previously discussed.

The output signal is supplied to operational amplifier 69 which is provided with diodes 86 and 87 to provide signal amplification in a logarithmic manner. In many applications the dynamic range determined by the second group of acoustic signals is extremely large and non-linear amplification is utilized to compress the range. The output signal from the amplifier 69 is supplied to operational amplifier 88 which has a normally low output level. The signal from amplifier 88 charges capacitor 85 to a peak level that is determined by the amplitude of the second acoustic signal after $t_1$ and is essentially maintained from the time of occurrence of the second acoustic signal.

The voltage on capacitor 85 is supplied via operational amplifier 90 to the adder circuit containing operational amplifier 91 and zener diode 92. The adder circuit provides a particular dc level and the temperature compensation for the logarithmic amplifier. Many different circuits may be utilized for compensation. The output signal from the amplifier 91 is determined by the peak voltage stored on capacitor 85 as corrected by the voltage across diode 92 and is coupled to control the gain of operational amplifier 70.

When the signal is received the amplified signal is supplied to the signal switch containing transistor 93. Referring to the waveforms of FIG. 4, the output signals from the strobe timer and the delay timer are supplied to NOR gate 75 so that the output of the NOR gate is high except for the interval $t_4$–$t_2$. As a result, transistor 93 is normally conductive and no input signal is supplied to operational amplifier 94 except when the transistor is rendered non-conductive by the strobe gate signal.

After time $t_2$, acoustic signals received by microphone 60 and converted to electrical analogues are amplified by the variable gain amplifier and supplied from amplifier 94 to the filter bus which has four similar filter, integrator and comparator circuit combinations coupled thereto. In FIG. 5, the $f_1$ frequency combination is shown with $f_1$ equal to 2.9 Hz while $f_2$, $f_3$ and $f_4$ are 3.0, 4.0 and 5.0 Hz respectively. The filter configurations differed only in the resistive and capacitor values of the filters. As shown, the $f_1$ filter includes operational amplifier 95 and frequency selective network 96 in the feedback path. The 2.0 Hz signal, if present, is rectified by diodes 97, 98 and supplied to the $f_1$ integrator.

The integrator circuit contains transistor 99 which has its base connected to the output terminal of the control gate. The transistor 99 is normally on except during the $t_3$–$t_2$ interval so that signals having a 2.0 Hz frequency and occurring during that interval are integrated by the combination of operational amplifier 100 and fedback capacitor 101. The output signal from amplifier 100 is a function of the energy level of the 2.0 Hz frequency signal and is compared with the level set by potentiometer 102. The potentiometer is coupled to one input of amplifier 103 and an output signal occurs when the integrator output signal exceeds this level. This output signal along with those from the other circuit combinations is coupled by the comparator bus to a majority gate containing operational amplifier 104 and potentiometer 105. The majority gate output signal is stored in capacitor 79 and retained by the diode 106 and a large resistor 107 for a relatively long interval. The discharge of the storage capacitor 79 takes place through reset diode 84 coupled to the delay timer output terminal.

The signal from amplifier 94 is coupled to a silence sense inverter including operational amplifier 108. The amplifier output is normally high thereby charging capacitor 109 and providing an input signal to operational amplifier 110 along with the output signal from the inverter gate containing operational amplifier 111 also having a normally high output signal. The presence of an acoustic signal after time $t_2$ results in the low output signal condition at amplifier 108.

The amplifier 110 of the silence gate has a normally low output state which is driven high upon the no input signal condition at amplifier 108 and the termination of the timer input signal to inverter gate 77 which occurs at time $t_3$.

The output signal from amplifier 110 and the voltage across capacitor 79 are supplied to alarm gate 112. The presence of both signals results in the alarm signal which can be utilized to actuate the particular alarm or indicating mechanism employed.

In the embodiment of FIG. 5 the following circuit components were utilized.

Amplifiers — 67, 68, 73, 74, 80, 81, 94, 95, 104, 108, 110, 111 are LM 3900 circuits.

Amplifiers 69, 88, 90, 91, 100 are LM 324 circuits.

Amplifier 70 is an LM 370N circuit with the LM designations referring to operational amplifiers available from National Semiconductor. The diodes are IN914 except for zener diode 92 which has an 1N 5230 designationa. Transistors 93 and 99 and designated Type 2N 3566.

Capacitors 83, 85 and 5.6 microF; 101 is 1.0 microF; 109 is 100 microF, and 79 is 1.0 microF. Other capacitor values in this embodiment are: $C_1$ = 0.1 microF; $C_2$ = 0.01 microF; $C_3$ = 200pf; $C_4$ = 6.8 microF; $C_5$ = 10pF; $C_6$ = 0.022 microF; $C_7$ = 1.0 microF; and $C_8$ = 3.6 microF.

Resistors have the following values:

| | | |
|---|---|---|
| $R_1$ 10K | $R_{10}$ 470K | $R_{19}$ 27K |
| $R_2$ 75K | $R_{11}$ 1K | $R_{20}$ 56K |
| $R_3$ 1M | $R_{12}$ 10M | $R_{21}$ 5.6K |
| $R_4$ 200K | $R_{13}$ 18K | $R_{22}$ 8.2K |
| $R_5$ 100K | $R_{14}$ 1.8K | $R_{23}$ 3.9K |
| $R_6$ 2M | $R_{15}$ 270K | $R_{24}$ 220K |
| $R_7$ 15K | $R_{16}$ 2.2K | $R_{25}$ 4.7M |
| $R_8$ 510K | $R_{17}$ 2K | $R_{26}$ 68K |

-continued

| | |
|---|---|
| $R_9$ 620K | $R_{18}$ 12K |

While the above description has referred to a preferred embodiment of the invention it is recognized that many variations and modifications may be made therein without departing from the scope of the invention as set forth in the appended claims.

What is claimed is:

1. A circuit for generating an electrical indicating signal in response to a pattern of acoustic signals which comprises:
   a. transducer means for receiving the acoustic signals and providing electrical signals at a first output terminal;
   b. threshold means coupled to said first output terminal and providing an output signal at a second output terminal in response to signals having a magnitude exceeding a threshold level;
   c. switch means coupled to said first output terminal and having a third output terminal and first control terminal, said switch means being actuated by a signal at said first control terminal;
   d. signal analyzing means coupled to the third output terminal and having a fourth output terminal and a second control terminal, said signal analyzing means being actuated by a signal at said second control terminal to indicate the presence of at least one frequency component in the signal at said third output terminal;
   e. output logic means coupled to the third and fourth output terminals and having a third control terminal and a fifth output terminal, said output means providing the electrical indicating signal at said fifth output terminal when actuated by a control signal and signals at the third and fourth output terminals, and
   f. timing circuit means coupled to the second output terminal and responsive to the signal from said threshold means for providing first, second and third actuating signals to the first, second and third control terminals respectively, the timing of said actuating signals being determined in accordance with the pattern of acoustic signals to be responded to.

2. The circuit in accordance with claim 1 wherein said signal analyzing means comprises:
   a. a plurality of frequency selective circuits coupled to said third output terminal, each of said circuit being adapted to pass at least one of a plurality of frequency components;
   b. means for determining the energy level of the frequency components passed by the frequency selective circuits and providing an output signal when the energy level of at least one component exceeds a threshold level, said output signal being supplied to the fourth output terminal of the signal analyzing means.

3. The circuit in accordance with claim 2 wherein said means for determining the energy level of the frequency components comprises:
   a. a plurality of integrating circuits each of which is coupled to the output of a frequency selective circuit and to the second control terminal of the signal analyzing means, the integrating circuits being actuated by the application of said second actuating signal thereto;
   b. a plurality of comparator circuits each of which is coupled to the output of an integrating circuit, each of said comparators providing an output signal when the signal from the corresponding integrating circuit is at least as large as a threshold level, and
   c. a gate circuit coupled to the outputs of the comparator circuits for providing an output signal indicating the condition of at least one of the frequency components having an energy level at least as large as the corresponding threshold level.

4. The circuit in accordance with claim 3 wherein said gate circuit is a majority gate for providing an output signal at the fourth terminal when a majority of the frequency components have an energy level at least as large as the corresponding threshold level.

5. The circuit in accordance with claim 3 wherein said timing circuit means comprises a control gate coupled to the threshold means and having an output terminal coupled to the second control terminal of the signal analyzing means, said control gate providing the second actuating signal after an interval following the output signal of the threshold means.

6. The circuit in accordance with claim 5 wherein said timing circuit means further comprises a strobe gate coupled to the threshold means and having an output terminal coupled to the first control terminal of the switch means, said strobe gate providing the first actuating signal after an interval following the output signal of the threshold means.

7. The circuit in accordance with claim 3 wherein said switch means comprises:
   a. a sampling circuit coupled to the first output terminal of the transducer means and providing a gain control signal having a magnitude which is a function of the magnitude of the signal at said first output terminal;
   b. a variable gain amplifier coupled to the first output terminal of the transducer means and having a gain control terminal coupled to the sampling circuit, the gain of said amplifier being controlled by gain control signal;
   c. a signal switch coupled to the output of the amplifier and to the third output terminal, said signal switch being coupled to the first control terminal and actuated by the first actuating signal from the timing circuit means.

8. The circuit in accordance with claim 7 wherein said sampling circuit comprises:
   a. an amplifier coupled to the first output terminal of the transducer means for providing a signal which is proportional to the magnitude of the acoustical signal received by the tranducer, and
   b. a peak detector coupled to said amplifier for receiving the output signal therefrom at a time subsequent to the expected duration of the acoustic signal producing an output from the threshold means and maintaining a gain control signal level during the remaining interval of the pattern, the output of the peak detector being coupled to the gain control terminal of the variable gain amplifier.

9. The circuit in accordance with claim 7 wherein said timing circuit comprises:
   a. a timer coupled to the second output terminal and responsive to the output signal of the threshold means, said timer providing a timing signal during the intervals in which acoustic signals are to be present in the pattern;

b. a delay timer responsive to the timing output signal for providing a delayed timing signal, said delayed timing signal starting at the end of the first interval in which acoustic signals are to be present in the pattern;

c. a strobe timer responsive to the delayed timing signal for providing a strobe timing signal, said strobe timing signal, starting at the beginning of the second interval in which acoustic signals are to be present in the pattern;

d. a strobe gate responsive to the delayed timing signal and strobe timing signal for providing a first actuating signal at the fist control terminal;

e. a control gate responsive to the timing signal and the strobe timing signal for providing a second actuating signal at the second control terminal, and f. an inverter gate responsive to the timing signal and delayed timing signal for providing a third actuating signal at the third control terminal.

10. The circuit in accordance with claim 9 wherein the output logic means comprises:

a. storage means coupled to the fourth output terminal of the signal analyzing means for receiving the output signal from the gate circuit and maintaining the output signal at its output terminal for the remaining portion of the acoustic pattern interval;

b. an inverter circuit coupled to the third output terminal for providing an output signal in the absence of a signal at said third output terminal;

c. a silence gate coupled to the third control terminal and said inverter circuit for providing an output signal indicating the absence of an acoustic signal at the end of the second interval in which acoustic signals are to be present in the pattern, and d. an alarm gate coupled to the storage means and the silence gate, said alarm providing the electrical indicating signal at the fifth output terminal.

11. In an alarm system for generating an electrical alarm signal in response to a pattern of acoustic signals wherein a transducer is positioned to receive the acoustic signals and generate corresponding electrical signals, the electrical alarm circuit which comprises:

a. threshold means connected to receive the electrical signals from the transducer and provide an output signal for received signals having a magnitude at least as large as a threshold level;

b. timing circuit means connected to receive the output signal from the threshold means and be actuated thereby to provide a control signal;

c. a signal analysis circuit for receiving the electrical signals from the transducer and determining the presence of a plurality of frequency components within the electrical signals, said signal analysis circuit being actuated by the control signal of said timing circuit means to provide an output signal indicating the presence of the frequency components, and d. output logic means connected to receive the output signal from the signal analysis circuit and the electrical signals from the transducer, said output logic means providing the electrical alarm signal indicating receipt of said output signal and termination of the electrical signals from the transducer.

12. The electrical alarm circuit in accordance with claim 11 wherein said signal analysis circuit includes:

a. means for determining the energy level in said frequency components;

b. comparator means for providing an output signal for each frequency component having an energy level at least as large as a threshold level, and c. a majority gate for receiving the output signals from the comparator means, said majority gate providing the signal analysis circuit output signal indicating a majority of frequency components having an energy level at least as large as the corresponding threshold level.

13. The electrical alarm circuit in accordance with claim 12 further comprising:

a. a variable gain amplifier circuit connected to receive the electrical signals from the transducer, the signals from said amplifier circuit being supplied to the signal analysis circuit, and b. means for sampling the electrical signals from the transducer and providing a gain control signal to said amplifier circuit.

14. The electrical alarm circuit in accordance with claim 13 wherein said timing circuit means provides first and second control signals and includes delay means for initiating first and second control signals a first interval after receipt of a first acoustic signal having a magnitude such as causes said threshold means to generate an output signal, and said variable gain amplifier circuit further comprising switch means actuated by the first control signal, the second control signal being supplied to the signal analysis circuit.

15. The electrical alarm circuit in accordance with claim 14 wherein said timing circuit means further comprises means for providing a thrid control signal at a predetermined interval following the generation of the first and second control signals, and said output logic means includes gate means coupled to receive the third control signal, said third control signal determining the timing of the generation of the electrical alarm signal.

16. A system for identifying a sequence containing first and second intermittent acoustic signals and generating an electrical alarm signal in response thereto, said system comprising:

a. transducer means for receiving the acoustic signals and converting them into electrical signals;

b. threshold means coupled to said transducer means for providing an output signal for received signals having a magnitude at least as large as a threshold level;

c. a timing circuit coupled to said threshold means and being actuated thereby to generate first, second and third control signals, said first control signal being provided for the duration during which the second acoustic signal in the sequence is expected and a predetermined interval thereafter, said second control signal being provided for the duration during which said second acoustic signal is expected, said third control signal being provided after said first control signal;

d. signal switch means coupled to receive electrical signals from said transducer means and being actuated by the first control signal from said timing circuit;

e. a signal analysis circuit coupled to receive signals from the signal switch means when actuated, said signal analysis circuit being actuated by the second control signal from said timing circuit, said signal analysis circuit determining the presence of at least one frequency component in the second acoustic signal in the sequence and providing an output signal indicative thereof; and f. an output logic circuit coupled to receive the output signal from the signal analysis circuit and being coupled to the signal switch means, said output logic circuit being actuated by the third control signal and providing the electrical alarm signal on occurrence of an output signal from the signal analysis circuit together with the absence of a signal from the signal switch means during the interval of the third control.

17. The system in accordance with claim 16 wherein said signal analysis circuit comprises:

a. means for determining the energy level in a plurality of frequency components within the electrical signals from the signal switch means;

b. comparator means for providing an output signal for each frequency component having an energy level at least as large as a threshold level, and c. a majority gate for receiving the output signals from the comparator means, said majority gate providing the signal analysis circuit output signal to the output logic circuit.

18. The system in accordance with claim 17 further comprising:

a. a variable gain amplifier circuit connected to receive the electrical signals from the transducer means, the signals from said amplifier circuit being supplied to the signal switch means, and b. means for sampling the electrical signals from the second acoustic signal receiving by said transducer means, and providing a gain control signal for the amplifier circuit during the sequence.

19. The system in accordance with claim 18 wherein said timing circuit comprises:

a. a timer actuated by the output signal from the threshold means to provide a timer signal continuing during the interval of an expected second acoustic signal;

b. a delay timer actuated by the timer signal to provide a delay signal continuing during said predetermined interval;

c. a strobe timer actuated by the delay signal to provide a strobe signal continuing during said predetermined interval;

d. a strobe gate coupled to receive the delay signal and strobe signal for providing the first control signal;

e. a control gate coupled to receive the timer signal and the strobe signal for providing the second control signal, and f. an inverter gate coupled to receive the timer signal and the delay signal for providing the third control signal to the output logic circuit.

20. The system in accordance with claim 19 wherein said transducer means includes a plurality of remotely located transducers and summing amplifier coupled to receive the output signals from said plurality of transducers.

* * * * *